343-700 MS AU 254 EX

6/15/82 OR 4,335,385

United States Patent [19]

Hall

[11] 4,335,385

[45] Jun. 15, 1982

[54] STRIPLINE ANTENNAS

[75] Inventor: Peter S. Hall, Swindon, England

[73] Assignee: The Secretary of State for Defence in Her Britannic Majesty's Government of the United Kingdom of Great Britain and Northern Ireland, London, England

[21] Appl. No.: 55,259

[22] Filed: Jul. 6, 1979

[30] Foreign Application Priority Data

Jul. 11, 1978 [GB] United Kingdom ..... 29460/78

[51] Int. Cl.[3] ..... H01Q 1/38

[52] U.S. Cl. ..... 343/700 MS; 343/846

[58] Field of Search ..... 343/700 MS, 806, 846, 343/854, 731, 708

[56] References Cited

U.S. PATENT DOCUMENTS

| | | | |
|---|---|---|---|
| 3,231,894 | 1/1966 | Nagai et al. | 343/806 |
| 3,689,929 | 9/1972 | Moody | 343/802 |
| 4,021,810 | 5/1977 | Urpo et al. | 343/846 |
| 4,063,245 | 12/1977 | James et al. | 343/700 MS |
| 4,203,116 | 5/1980 | Lewin | 343/846 |
| 4,238,798 | 12/1980 | Aitken et al. | 343/846 |
| 4,260,988 | 4/1981 | Yanagisawa et al. | 343/700 MS |
| 4,286,271 | 8/1981 | Barbano | 343/846 |
| 4,293,858 | 10/1981 | Hockham | 343/846 |

FOREIGN PATENT DOCUMENTS

| | | |
|---|---|---|
| 1547105 | 12/1967 | France . |
| 1195900 | 6/1970 | United Kingdom . |

*Primary Examiner*—David K. Moore

*Attorney, Agent, or Firm*—Pollock, Vande Sande & Priddy

[57] ABSTRACT

A length of microstrip line turns through successive right-angle corners to form a rectangular pattern comprising successive quartets of such corners. Each right-angle corner radiates with a polarization which is predominantly diagonal, and the strip lengths between the corners of each quartet are made such, in relation to the operating wavelength in the strip, that the radiation from each quartet sums to produce a desired polarization direction, e.g. vertical, horizontal, or circular of either hand. Some forms of the invention can be used in a resonant as well as a travelling-wave mode, the latter giving a main lobe whose direction sweeps with frequency.

16 Claims, 7 Drawing Figures

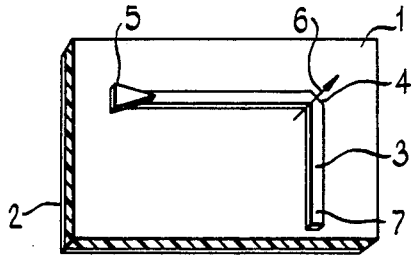
Fig. 1
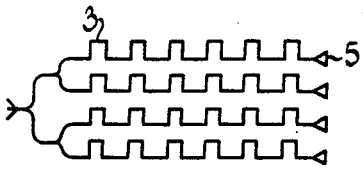
Fig. 6
Fig. 2
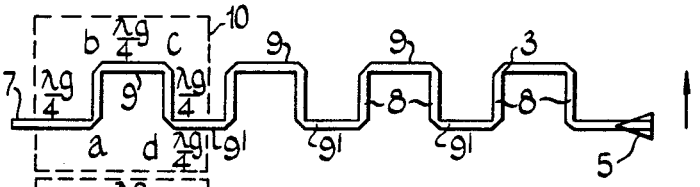
Fig. 3
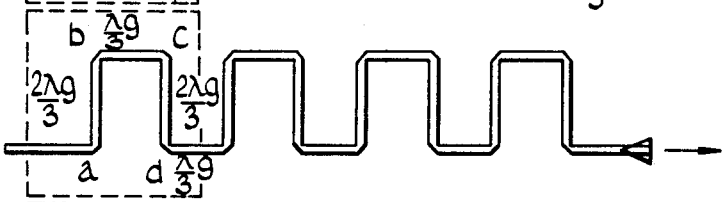
Fig. 4
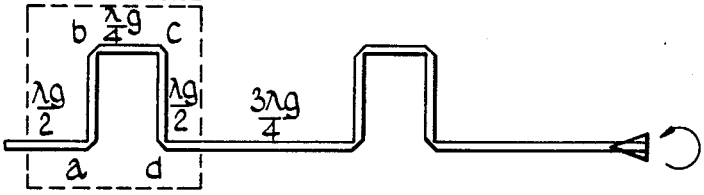
Fig. 5
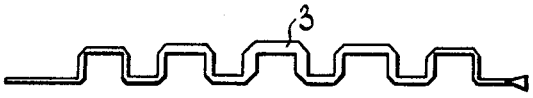
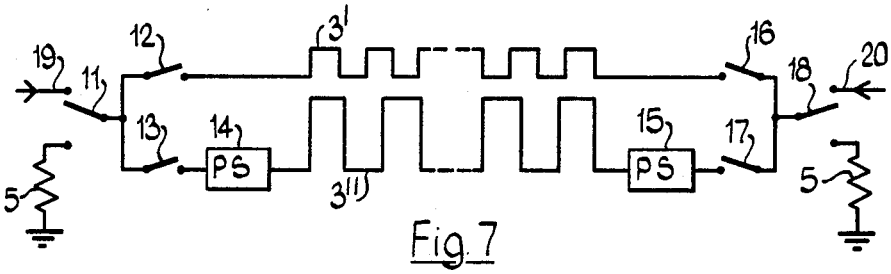
Fig. 7

STRIPLINE ANTENNAS

BACKGROUND OF THE INVENTION

This invention relates to stripline antennas, in particular stripline antenna arrays.

One advantage of the present invention is that it can provide a travelling-wave array having circular polarization. Most existing arrays having circular polarization use resonant elements and are therefore relatively narrow-band arrangements, which is a disadvantage when a frequency-swept antenna array is required, ie one in which the direction of the main lobe is varied by varying the operating frequency. Other forms of the invention can have linear polarization in a desired direction, and some forms can be used in a resonant as well as a travelling-wave mode.

SUMMARY OF THE INVENTION

According to the present invention a stripline antenna array comprises:

- a pattern of conducting material on an insulating substrate having a conducting backing;
- said pattern including at least one strip which turns through successive right-angle corners to form a plurality of parallel transverse sections each connected to the next transverse section by one of a plurality of parallel longitudinal sections;
- the course of the strip and the section lengths between successive corners being such that, if connected to a source of appropriate frequency and appropriately terminated, the phase relationships between the radiation from each successive plurality of corners along the pattern produce, in sum, the same predetermined polarization direction.

The transverse sections may be spaced consecutively along the pattern in the order in which they are connected together by the longitudinal sections. The successive pluralities of corners may be successive quartets of corners.

The section lengths in relation to the wavelength in the strip may be such that the resulting polarization direction is vertical, or horizontal, or circular.

In a preferred form of the present invention a stripline antenna array comprises:

- a pattern of conducting material on an insulating substrate having a conducting backing;
- said pattern including at least one strip which comprises a plurality of equal-length parallel transverse sections whose ends lie on two parallel lines, each transverse section being connected to the next succeeding transverse section by a longitudinal section, successive longitudinal sections being connected alternately at opposite ends of the transverse sections and the sections meeting in right-angle corners;
- the lengths of the transverse and longitudinal sections being such that, if operated in a travelling-wave mode, the summed radiation from each successive quartet of corners has the same predetermined polarization direction.

The term "stripline" includes any suitable form of open-strip transmission line (eg not triplate) including microstrip.

It is known that radiation is emitted from discontinuities in striplines and that a right-angle corner in a stripline radiates with a polarization which is predominantly diagonal. The present invention utilizes this effect and, in the preferred form of the invention, relates the section lengths between successive corners of each quartet to the operating wavelength in such a way that the phases of the radiation from these four successive corners produce, in sum, the desired polarization. In determining the section lengths, allowance is made for the phase errors known to exist at such corners. The input is fed to one end of the stripline and the other end left open-circuit (for resonant operation) or terminated with the characteristic impedance of the line (for travelling-wave operation), as required for the desired polarization.

In this Specification vertical polarization means polarization parallel to the transverse sections of the stripline, and horizontal polarization means polarization parallel to the longitudinal sections of the stripline. In circular polarization, as is known, the polarization direction rotates continuously and the rotation may be either right-handed or left-handed. The radiation referred to in the present Specification is the so-called broadside radiation, and (apart from the effect of frequency-sweeping) is emitted in a direction normal to the plane of the pattern.

Vertical polarization can be obtained by, for example, making the transverse and longitudinal section lengths between the corners of each quartet $\lambda g/4$, where $\lambda g$ is the wavelength in the stripline, and terminating one end of the stripline with its characteristic impedance, ie operating in a travelling-wave mode.

Horizontal polarization can be obtained by, for example, making each transverse section $2\ \lambda g/3$ and each longitudinal section $\lambda g/3$ in length between the corners of each quartet and terminating one end with the characteristic impedance.

To obtain circular polarization, each transverse section can be made $\lambda g/2$ in length and each longitudinal section $\lambda g/4$ between the corners of each quartet, terminating one end with the characteristic impedance. The direction of rotation of the circular polarization depends on which end is so terminated. If the end is left open-circuit (resonant-mode operation) this species of the invention gives vertical polarization.

To obtain constant phase as between successive quartets of corners, the section lengths between successive quartets are made the appropriate fraction of a wavelength to maintain the same phase at the first corner of each quartet, ie the distance along the strip between successive first corners is an integral number of wavelengths.

Operated as travelling-wave structures, all three aforesaid species of the invention produce a main lobe whose direction sweeps with frequency in a known manner.

Preferably each right-angle corner has its outer apex truncated, which reduces the reactive component of the stripline impedance at the discontinuity.

The amount of radiation from a discontinuity is known to depend inter alia on the line width. In the present invention the aperture distribution can thus be tapered along the stripline by progressively increasing its width from the two ends towards the center so that more power is radiated off in the central region.

A plurality of stripline patterns as aforesaid may be arranged side-by-side, suitably on a common substrate, and fed in parallel.

Two stripline patterns as aforesaid having respectively vertical and horizontal polarization may be arranged side-by-side, suitably on a common substrate, phase-shifting means being connectable in series with one or both arrays so that they produce, in combination, polarization in a desired intermediate direction, or circular polarization.

The present invention also provides a stripline antenna having at least one element or cell comprising:

a strip of conducting material on an insulating substrate having a conducting backing;

said strip turning through four successive right-angle corners, two of one hand (right or left) and two of the other hand, at least one corner of a given hand immediately following the other corner of the same given hand;

the strip lengths between successive corners being so related that if connected to a source of appropriate frequency and appropriately terminated, the phase relationships between the radiation from the corners produce, in sum, a predetermined polarization direction.

The strip lengths between successive corners may be such fractions of the operating wavelength in the strip that if operated in a travelling-wave mode, the summed radiation from the four corners is polarized either parallel to one or other of the two orthogonal strip directions or is circularly polarized, depending on the values of said fractions.

As indicated above, for vertical, horizontal or circular polarization, the section lengths between corners are integral multiples of a given fraction of the wavelength (where "multiple" includes unity). Polarization directions other than these three can be obtained from a multi-cell or single-cell strip, but in such cases the section lengths may not be integral multiples of a given fraction of the wavelength.

DESCRIPTION OF THE DRAWINGS

To enable the nature of the present invention to be more readily understood, attention is directed, by way of example, to the accompanying drawings wherein:

FIG. 1 shows a right-angle corner in a length of stripline.

FIGS. 2, 3 and 4 show diagrammatically species of a preferred form of the present invention giving respectively vertical, horizontal and circular polarization.

FIG. 5 shows a stripline similar to those shown in FIGS. 2, 3 and 4 but of varying width.

FIG. 6 shows a plurality of striplines similar to those of FIGS. 2, 3 and 4, arranged side-by-side and fed in parallel.

FIG. 7 shows two striplines as in FIGS. 2 and 3 respectively arranged side-by-side and connectable to give, in combination, various forms of polarization.

DESCRIPTION OF PREFERRED EMBODIMENTS

Referring to FIG. 1, a dielectric sheet 1, originally metal-coated on both faces, has one face etched to form the pattern shown, leaving the other face 2, for use as a ground plane. The pattern comprises a strip 3 having a right-angle bend whose apex is truncated at 4 and having one end terminated by resistive card load 5 which is matched to the characteristic impedance of the the stripline constituted by the strip 3 in conjunction with the dielectric and ground plane. It is found that if a RF input is applied to the unterminated end 7 of strip 3, radiation is emitted at the right-angle corner in the broadside direction, ie normal to the plane of the drawing, and that polarization is predominantly diagonal, as indicated by the arrow 6. The equivalent circuit of such a corner can be represented by the radiation conductance in parallel with a capacitative component. Truncating the corner reduces the latter component (a similar practice is known in triplate circuits) and enables a match to be obtained over a band of frequencies.

In FIGS. 2 to 4, the dielectric and ground plane are omitted for clarity. In each of these figures, the strips 3 turns through a succession of right-angle corners to form a plurality of transverse equal-length sections 8 connected by a plurality of longitudinal sections 9, 9'. Each successive quartet of corners is seen to be located at the corners of a succession of similar notional rectangles spaced apart along the strip. The striplines are terminated by their characteristic impedances 5 as in FIG. 1 and the RF input applied to the unterminated ends 7, thereby establishing travelling-waves along the striplines.

In FIG. 2 the lengths of sections 8 and 9, 9' are each $\lambda g/4$, where $\lambda g$ is the wavelength in the stripline. Considering the radiating "cell" bounded by the interrupted line 10 and containing the first quartet of corners, a,b,c,d located at the corners of a notional rectangle, the phases of the horizontally and vertically polarized contributions from each of these corners is shown in Table I, together with their sums. The radiation is assumed of amplitude A and polarization as in FIG. 1. It will be seen that, for FIG. 2, the horizontal contributions cancel out, and the resultant radiation is vertically polarized. It should be noted that this summation only applies to the main lobe of the radiation pattern. Off the main lobe the relationships shown in Table I do not hold and the polarization departs from that calculated. Each subsequent cell behaves similarly, and the radiation from all the cells is additive; the radiation from all the cells is in the same phase, since the length of the sections 9' between adjacent cells is such as to maintain the same phase at each corner a. (It is also apparent that a cell or element of four consecutive corners comprising up to three from the first quartet and the remainder from the second quartet will behave similarly to that described).

In FIG. 3 the lengths of sections 8 and 9, 9' are $\lambda g/3$ and $2\ \lambda g/3$ respectively. As shown in Table I, the sum of the contributions from the four corners in this case gives horizontal polarization.

In FIG. 4 the length of the sections 8 is $\lambda g/2$, and the sections 9 and 9' are respectively $\lambda g/4$ and $3\ \lambda g/4$. The sums of the horizontal and vertical contributions in this case represent two components of amplitude $\sqrt{2}A$ and in 90° out of time phase giving right-hand circular polarization. If the input and load connections are reversed, the two sums shown are transposed, giving left-hand circular polarization. If the matched load 5 is omitted, so that the array is operated as a resonant structure, FIG. 3 produces vertical polarization, like FIG. 2.

The amount of radiation from discontinuities in striplines increases with the line width. Taking advantage of this known effect, the lines shown in FIGS. 2 to 4 can be made progressively wider towards the center from each end, as shown in FIG. 5, so that more power is radiated from the center.

TABLE 1

| Corner | FIG. 2 Polarization → Horizontal | FIG. 2 Polarization ↑ Vertical | FIG. 3 Polarization → Horizontal | FIG. 3 Polarization ↑ Vertical |
|---|---|---|---|---|
| a | $\frac{A}{\sqrt{2}}$ | $-\frac{A}{\sqrt{2}}$ | $\frac{A}{\sqrt{2}}$ | $-\frac{A}{\sqrt{2}}$ |
| b | $-\frac{A}{\sqrt{2}}e^{-j\frac{\pi}{2}}$ | $\frac{A}{\sqrt{2}}e^{-j\frac{\pi}{2}}$ | $-\frac{A}{\sqrt{2}}e^{-j\frac{4\pi}{3}}$ | $\frac{A}{\sqrt{2}}e^{-j\frac{4\pi}{3}}$ |
| c | $\frac{A}{\sqrt{2}}e^{-j\pi}$ | $\frac{A}{\sqrt{2}}e^{-j\pi}$ | $\frac{A}{\sqrt{2}}e^{-j2\pi}$ | $\frac{A}{\sqrt{2}}e^{-j2\pi}$ |
| d | $-\frac{A}{\sqrt{2}}e^{-j\frac{3\pi}{2}}$ | $-\frac{A}{\sqrt{2}}e^{-j\frac{3\pi}{2}}$ | $-\frac{A}{\sqrt{2}}e^{-j\frac{10\pi}{3}}$ | $-\frac{A}{\sqrt{2}}e^{-j\frac{10\pi}{3}}$ |
| Sum of a,b,c,d | 0 | $-A\sqrt{2}\left(1-e^{-j\frac{\pi}{2}}\right)$ | $A\sqrt{2}\left(1-e^{-j\frac{4}{3}\pi}\right)$ | 0 |
| Result | Vertical Polarization | | Horizontal Polarization | |

| Corner | FIG. 4 Polarization → Horizontal | FIG. 4 Polarization ↑ Vertical |
|---|---|---|
| a | $\frac{A}{\sqrt{2}}$ | $-\frac{A}{\sqrt{2}}$ |
| b | $-\frac{A}{\sqrt{2}}e^{-j\pi}$ | $\frac{A}{\sqrt{2}}e^{-j\pi}$ |
| c | $\frac{A}{\sqrt{2}}e^{-j\frac{3\pi}{2}}$ | $\frac{A}{\sqrt{2}}e^{-j\frac{3\pi}{2}}$ |
| d | $-\frac{A}{\sqrt{2}}e^{-\frac{5\pi}{2}}$ | $-\frac{A}{\sqrt{2}}e^{-j\frac{5\pi}{2}}$ |
| Sum of a,b,c,d | $A\sqrt{2}\left(1-e^{-j\frac{\pi}{2}}\right)$ | $-A\sqrt{2}\left(1+e^{-j\frac{\pi}{2}}\right)$ |
| Result | Circular Polarization | |

The effect is to taper the aperture distribution of the array along the line, which is desirable in some applications.

Table II shows the results of measurements on sample arrays of each of the kinds shown in FIGS. 2 to 4, with travelling-waves. All the arrays used striplines of uniform width, ie unlike FIG. 5, which produced an exponentially tapered aperture distribution with theoretical sidelobe levels of about −13 dB. It can be seen that the bandwidth, defined for the arrays of FIG. 2 and FIG. 3 in terms of sidelobe level being below a specified level, is very wide for FIG. 2, less so for FIG. 3. For FIG. 4 the bandwidth is defined in terms of the ellipticity being less than a specified level. (The ellipticity is the ratio of the instantaneous amplitudes of the radiation when polarized in the vertical and horizontal directions). The reduction in efficiency with FIG. 4 as compared with FIG. 2 is due to the number of corners been halved, and means that much more power is lost in the load 5. However this loss can be controlled by varying the stripline width as described with reference to FIG. 5.

To illustrate the variation in main-lobe direction with frequency-sweep, taking the direction normal to the plane of the array of FIG. 2 as 0°, the direction at the center frequency 4.0 GHz was approximately 2° and the directions at 4.5 GHz and 5.0 GHz were approximately 21° and 36° respectively.

The array of FIG. 4 was found to produce grating lobes, due to the relatively large spacing of 3 λg/4 between adjacent quartets of corners. These can be reduced or removed by using a sufficiently high dielectric constant for the sheet 1 (FIG. 1).

The results in Table II were obtained with arrays having the following characteristics:

| | |
|---|---|
| Material | 3M Cuclad (Regd Trade Mark) (or equivalent) |
| Dielectric thickness (sheet 1) | 1.6 mm (1/16 inch) |
| Dielectric constant (sheet 1) | 2.32 |
| Strip width | 5.0 mm |
| Strip thickness | 0.036 mm (1.4 thou) |
| Depth of truncation 4 (from apex along diagonal) | 3.5 mm |
| Line impedance | 50 ohms |

The FIG. 2 results were obtained with an array of ten cells; the FIGS. 3 and 4 results with arrays of five cells.

TABLE II

| | FIG. 2 | FIG. 3 | FIG. 4 |
|---|---|---|---|
| Polarization | Vertical | Horizontal | Circular |
| Ellipticity, dB | | | <2.0 |
| Cross Polarization, dB | < −16 | < −14 | |
| Sidelobe Level, dB | < −10 < −11 | < −8 | < −6 |
| Bandwidth, % | 44 25 | 12 | 7 |
| Return Loss, dB | < 13 except at broadside (6) | | < 10 inc. broadside |
| Center Freq | 4.0 GHz | 5.0 GHz | 3.7 GHz |
| Efficiency % | 60 | | 27 |
| Load Loss, % | 16 | | 50 |

TABLE III

| Polarization | 11 | 12 | 13 | 14 | 15 | 16 | 17 | 18 |
|---|---|---|---|---|---|---|---|---|
| ↑ | i/p | on | off | — | — | on | off | load |
| → | i/p | off | on | $O^o$ | $O^o$ | off | on | load |
| ↗ | i/p | on | on | $\alpha^o$ | $O^o$ | on | on | load |
| ↖ | i/p | on | on | $\beta^o$ | $O^o$ | on | on | load |
| ↻ | i/p | on | on | $\gamma^o$ | $O^o$ | on | on | load |
| ↺ | load | on | on | $O^o$ | $\gamma^o$ | on | on | i/p |

FIG. 6 shows a two-dimensional array comprising a plurality of similar striplines as shown in FIGS. 2, 3 or 4 arranged side-by-side on a common sheet 1 and face 2 (not shown) and fed in parallel. Such an array will produce a pencil beam of the desired polarization, ie a beam which is narrow in the plane normal to sheet 1 and parallel to the transverse sections 8. (FIGS. 6 and 7 are symbolic and the truncated corners are not shown).

FIG. 7 shows a variable polarization array embodying the present invention. It comprises an array 3' of the kind shown in FIG. 2 and an array 3'' of the kind shown in FIG. 3 arranged side-by-side on a common sheet 1 and face 2. Switches 11 to 13 and 16 to 18 are arranged to optionally connect either end of each line to alternative input connections 19,20 or to its characteristic impedance 5. Phase shifters 14,15 are connected between each end of array 3'' and switches 13 and 17 respectively. Depending on the positions of the switches, on or off (ie closed or open), radiation of different polarization is radiated broadside from the combination, as shown in Table III. The phase shifts $\alpha$, $\beta$ and $\gamma$ required of phase shifters 14 and 15 can be determined from the relative phases of the horizontally and vertically polarized components in Table I. Thus the value of $\alpha$ must be such as to bring the vertical component of phase $-(1-e^{-j\pi/2})$ and the horizontal component of phase $(1-e^{-j4\pi/3})$ into phase; similarly, the value of $\beta$ must be such that the horizontal component is 180° out of phase from that for $\alpha$, and the value of $\gamma$ must be such that the two components are 90° out of phase.

For intermediate polarization, phase shifter 14 can be given more phase steps. To reduce radiation from conductors other than the arrays 3', 3'' themselves, the former may be made in triplate. To reduce grating lobes in the plane normal to sheet 1 and parallel to transverse sections 8 in a two-dimensional form, high electric-constant substrates can be used.

Although in an array comprising a pattern having a plurality of cells each cell ideally has a complete quartet of radiating corners as described, it is apparent that some deviation from this perfect symmetry, eg in a long array an incomplete cell lacking one or more corners and located at one or both ends of the array, may be permitted without seriously affecting the performance.

Only embodiments giving vertical, horizontal or circular polarization have been described by way of example. Embodiments giving other desired polarizations are possible although the section lengths may not then be integral multiples of a given fraction of the wavelength as in the described examples.

It will be appreciated that, although described in relation to their use as transmitting arrays or elements, the present antennas can, as normal, also be used for receiving.

The present invention is to be distinguished from the antennas described in Canadian Pat. No. 627,967 with particular reference to FIGS. 13 and 14 thereof. The latter figures disclose a strip forming successive groups of very closely spaced right-angle corners, each group forming essentially a single radiating source, with the groups spaced relatively far apart by a suitable fraction of a wavelength to determine the array radiation pattern in a conventional manner. Thus this Canadian Patent does not teach that control of polarization can be achieved by suitable inter-corner phase relationships, as described in the present Specification. The present invention is also to be distinguished from known symmetrical zig-zag forms of strip array, as described by G v Trentini in Frequenz, vol. 14, no. 7, pp 239–243 (1960) which likewise do not have the present properties.

I claim:

1. A stripline antenna array comprising:

a pattern of conducting material on an insulating substrate having a conducting backing;

said pattern including at least one strip having an input connection at one end thereof for supplying energy to said array, said array having a longitudinal axis, said strip being configured to turn through successive right-angle corners to form a plurality of transverse sections that are substantially normal to the longitudinal axis of, and spaced along, the array, each transverse section being connected to the next succeeding transverse section by one of a plurality of longitudinal sections that are substantially parallel to the longitudinal axis of the array;

the array being substantially divisible longitudinally into a plurality of similar successive strip-portions all containing the same number of corresponding right-angle corners, the angular configuration of the corners and the section lengths between successive corners being such in relation to a given operating wavelength in said strip that, when said strip is appropriately terminated, the phases of the resultant diagonally-polarized radiation from the corners in each strip-portion produce, in sum, the same predetermined polarization direction from all the cells.

2. An array as claimed in one of claim 1, 5 or 6 wherein the outer apex of each right-angle corner is truncated.

3. An array as claimed in claim 1 wherein the successive pluralities of corners are successive quartets of corners.

4. An array as claimed in claim 3 wherein the section lengths in relation to the operating wavelength in the strip are such that the resulting polarization direction is vertical.

5. An array as claimed in claim 3 wherein the section lengths in relation to the operating wavelength in the strip are such that the resulting polarization direction is horizontal.

6. An array as claimed in claim 3 wherein the section lengths in relation to the operating wavelength in the strip are such that the resulting polarization direction is circular.

7. A stripline antenna array comprising:

a pattern of conducting material on an insulating substrate having a conducting backing;

said pattern including at least one strip having an input connection at one end thereof for feeding energy to the array, said strip comprising a plurality of equal-length parallel transverse sections whose ends lie on two parallel lines, each transverse section being connected to the next succeeding transverse section by a longitudinal section, successive longitudinal sections being connected alternatively at opposite ends of the transverse sections, and the sections meeting in right-angle corners;

the angular configuration of the corners and the lengths of the transverse and longitudinal sections in relation to the operating wavelength in the strip being such that, if operated in a travelling-wave mode, the summed radiation from each successive quartet of corners has the same predetermined polarization direction.

8. An array as claimed in claim 7 for producing vertical polarization, wherein the transverse and longitudinal section lengths between the corners of each quartet are one-quarter of the operating wavelength in the strip, and wherein the stripline is terminated with its characteristic impedance.

9. An array as claimed in claim 7 for producing horizontal polarization wherein each transverse section length between the corners of each quartet is two-thirds of the operating wavelength in the strip and the longitudinal section length between said corners is one-third of said wavelength, and wherein the stripline is terminated with its characteristic impedance.

10. An array as claimed in claim 7 for producing circular polarization wherein each transverse section length between the corners of each quartet is one-half of the operating wavelength in the strip and the longitudinal section length between said corners is one-quarter of said wavelength, and wherein the stripline is terminated with its characteristic impedance.

11. An array as claimed in any of claims 7 to 10 wherein the outer apex of each right-angle corner is truncated.

12. An array as claimed in any of claims 7 to 10 wherein the width of the stripline progressively increases from its two ends towards its center.

13. A stripline antenna array comprising an array as claimed in claim 8 and an array as claimed in claim 9 arranged side-by-side, connections for feeding said two arrays in parallel, and phase-shifting means connectable in series with one or both arrays so that said two arrays can produce, in combination, either polarization in a direction intermediate between horizontal and vertical, or circular polarization.

14. A stripline antenna comprising:

a strip of conducting material on an insulating substrate having a conducting backing, said strip having an input connection at one end thereof for feeding energy to the antenna;

said strip forming at least one element wherein the strip turns through four successive right-angle corners, two of one hand and two of the other opposite hand, at least one corner of a given hand immediately following the other corner of the same given hand;

the angular configuration of the corners and the strip lengths between successive corners being so related that if said input connection is connected to a source of appropriate frequency and appropriately terminated, the phase relationships between the radiation from the four corners produce, in sum, a predetermined polarization direction.

15. An antenna as claimed in claim 14 wherein the strip lengths between successive corners are such fractions of the operating wavelength in the strip that, if operated in a travelling-wave mode, the summed radiation from the four corners is polarized parallel to a selected one of the two orthogonal strip directions.

16. An antenna as claimed in claim 14 wherein the strip lengths between successive corners are such fractions of the operating wavelength in the strip that, if operated in a travelling-wave mode, the summed radiation from the four corners is circularly polarized.

* * * * *

UNITED STATES PATENT AND TRADEMARK OFFICE

CERTIFICATE OF CORRECTION

PATENT NO. : 4,335,385

DATED : June 15, 1982

INVENTOR(S) : Peter S. Hall

It is certified that error appears in the above—identified patent and that said Letters Patent is hereby corrected as shown below:

Column 7 line 54 change "electric" to -- dielectric --

Column 8 line 47 change "cells" to -- strip-portions --

Signed and Sealed this

*Seventh* Day of *September 1982*

[SEAL]

*Attest:*

GERALD J. MOSSINGHOFF

*Attesting Officer*

*Commissioner of Patents and Trademarks*